US006321854B1

(12) United States Patent
Bisutti

(10) Patent No.: US 6,321,854 B1
(45) Date of Patent: Nov. 27, 2001

(54) POWER TOOL

(76) Inventor: Giovanni Bisutti, 27 Newmarket Road, Cambridge (GB), CB5 8EG ( * ) Notice: Subject to any disclaimer, the term of this patent is extended or adjusted under 35 U.S.C. 154(b) by 0 days.

(21) Appl. No.: 09/485,563

(22) PCT Filed: Aug. 24, 1998

(86) PCT No.: PCT/GB98/02466

§ 371 Date: Feb. 11, 2000

§ 102(e) Date: Feb. 11, 2000

(87) PCT Pub. No.: WO99/10131

PCT Pub. Date: Mar. 4, 1999

(30) Foreign Application Priority Data

Aug. 22, 1997 (GB) ..... 9717699
Dec. 12, 1997 (GB) ..... 9726328

(51) Int. Cl.[7] ..... B25D 9/10

(52) U.S. Cl. ..... 173/206; 173/208; 173/212; 173/171; 173/204

(58) Field of Search ..... 173/206, 207, 173/208, 197, 198, 199, 171, DIG. 3, DIG. 4, 204, 105, 138, 74, 212

(56) References Cited

U.S. PATENT DOCUMENTS

| | | | | |
|---|---|---|---|---|
| 2,400,650 | | 5/1946 | Leavell et al. | 121/36 |
| 2,780,966 | * | 2/1957 | Frost et al. | 173/DIG. 3 |
| 3,150,488 | * | 9/1964 | Haley | 173/204 |
| 3,609,969 | * | 10/1971 | Gerber | 173/208 |
| 3,872,934 | * | 3/1975 | Terada | 173/207 |
| 3,918,532 | * | 11/1975 | Amtsberg | 173/208 |
| 4,094,365 | * | 6/1978 | Wanner | 173/105 |
| 4,100,977 | * | 7/1978 | Elliott | 173/207 |
| 4,291,771 | * | 9/1981 | Perraud | 173/DIG. 4 |

FOREIGN PATENT DOCUMENTS

| | | |
|---|---|---|
| 2325516 | 11/1974 | (DE) . |
| 2219958 A | 12/1989 | (GB) . |

* cited by examiner

*Primary Examiner*—Scott A. Smith
(74) *Attorney, Agent, or Firm*—Townsend and Townsend and Crew LLP

(57) ABSTRACT

A percussion power tool assembly (10) comprises a hand-held percussion power tool (11), a chamber (12) mounted on the tool (11), and a fluid reservoir (14) supported independently of the tool (11). The percussion power tool (11) has a body (20) housing a reciprocating hammer (22) which impacts against tool bit (24) in a conventional manner. The hammer (22) is operated by compressed air admitted though valve (26) in feed line (28). The chamber (12) communicates with the fluid reservoir (14) though flexible hose (16). The chamber (12) surrounds the body (20) and has a flexible lining (30) defining a bladder which inflates/deflates in sympathy with fluid filling, or emptying from, the chamber. The deadweight of the hand-held part (18) of the assembly (that is, the tool and chamber combined) is varied by transferring fluid, e.g. water, in the reservoir (14) to the chamber (12), and reduced by returning transferred fluid to the reservoir (14). In practice, the deadweight of the tool is reduced to facilitate moving the tool, and is increased when the tool is in use to achieve required reaction force between tool and work piece with reduced contribution from the operator.

27 Claims, 8 Drawing Sheets

POWER TOOL

FIELD OF THE INVENTION

The present invention relates to a power tool comprising a body housing a member with a reciprocating percussive action (a percussion power tool), and also to a system for varying the deadweight of apparatus such as percussion power tools.

BACKGROUND ART

In the construction industry and other fields of heavy engineering such as mining, percussion power tools are widely used, for example to break up hard surfaces, compact loose material such as back-fill, and drive posts or piles into the ground. The tools incorporate a reciprocating mass, usually driven by compressed air but also by other means, which repeatedly impacts against a load-bearing surface within the tool. The movement of the mass towards the surface is known as the power stroke, whilst the reverse movement is known as the return stroke. It is known, for example in so-called hammer action drills, to incorporate a ratchet mechanism to rotate the tool during the return stroke.

The total work output of percussion power tools is dependent on the extent to which the reaction force between the tool and the work piece is able to counteract the force acting on the reciprocating mass during the power stroke. With hand-held systems acting on the ground, the reaction force is given by the sum of the deadweight of the tool and any downward pressure applied by the operator. The maximum deadweight for conventional heavy-duty paving breakers is approximately 40 kgs, otherwise the tool becomes too heavy to lift. The maximum deadweight for conventional heavy-duty rock drills is around 25 kgs; such drills tend to be held by the operator in a much higher position compared with paving breakers and therefore, for ergonomic reasons, they must be lighter.

There is a trend with hand-held percussion power tools to minimise the contribution of the operator to the reaction force in order to increase operator comfort and reduce the risk of contracting hand/arm vibration syndrome, HAVS.

DISCLOSURE OF THE INVENTION

In accordance with a first aspect of the present invention, there is provided a percussion power tool comprising a body housing a member with a reciprocating percussive action, a chamber coupled to the body, means for introducing fluid into the chamber, and means for subsequently emptying fluid from the chamber, fluid being stored in the chamber to increase the deadweight of the tool when the member is reciprocating or percussing, and subsequently emptied when it is idle.

The invention thus provides a variable deadweight, and hence variable inertia, percussion power tool. In practice, the deadweight may be selected such that, at its minimum, the tool is readily moved and, at its maximum, the required reaction force between tool and workpiece is achieved. In the case of hand-held percussion power tools, the contribution of the operator to the reaction force required for efficient use should be as low as possible at least when the deadweight is at its maximum. In this way, the magnitude of undesirable vibration and kickback transmitted to the operator is reduced.

The means for introducing fluid into the chamber may comprise a reservoir, supported independently of the body, for storing fluid for the chamber. The reservoir may comprise a pressurizable vessel. The means for emptying fluid from the chamber may communicate with the reservoir, enabling fluid from the chamber to be returned to the reservoir. Such a closed system enables fluid to be recycled. Since fluid is not required to flow to and from the chamber at the same time, a single fluid conduit may link the reservoir and chamber.

The chamber may comprise a membrane, perhaps forming a bladder, which flexes in sympathy with fluid filling or emptying from the chamber. The membrane may expand to line the inner periphery of the chamber as fluid fills the chamber. Alternatively, the membrane may expand to line the inner periphery of the chamber as fluid empties from the chamber. The membrane may assist the use of compressed gas to empty the chamber of fluid. Alternatively, the chamber may house a sliding partition element (e.g. a piston) which moves in sympathy with fluid being introduced into or emptied from the chamber.

The reservoir may similarly comprise a membrane or piston which respectively flexes or slides in sympathy with fluid filling or emptying from the reservoir.

In one embodiment, the means for introducing fluid into the chamber and/or the means for emptying fluid from the chamber may be operated by compressed gas. The means for introducing fluid into the chamber and/or means for emptying fluid from the chamber and reciprocation of the member may be operated by compressed gas from a common supply. Compressed gas may be used to displace fluid in the chamber in order to drain the fluid from the chamber. Compressed gas may also be used to displace fluid in the reservoir in order to fill the chamber with displaced fluid. The percussion power tool may further comprise valve means for coupling to a compressed gas supply, the valve means controlling fluid displacement for filling and emptying the chamber and the reciprocating percussive action of the member in the tool (pneumatic action).

The valve means may comprise an arrangement combining compressed gas supply valves alternately for supplying compressed gas to the chamber and the reservoir, and bleed valves for alternately releasing compressed gas from the chamber and the reservoir in such a way that compressed gas supply to only one of the chamber or the reservoir activates release of compressed gas from the other only. The arrangement may thus be fed from a single line of compressed gas. Alternatively, the chamber and the reservoir may be fed from different lines of compressed gas, possibly from different compressors, thereby obviating the need for a conduit conveying compressed gas between the chamber and the reservoir. Synchronisation of the compressed gas supply and bleed valves of the chamber and reservoir may be achieved in various ways. For example, electrical interconnection of the valve actuators could be used to ensure that the opening of the supply valve of one of the chamber and reservoir is accompanied by the opening of the bleed valve of the other, all remaining valves being closed. Alternatively, a signal from pressure sensing means provided with the compressor for controlling compressor output could be used to operate the valves at the reservoir end.

The percussion power tool may further comprise drive means for reciprocating the member in the body, the drive means being arranged to drive a gas compressor which provides compressed gas for introducing fluid into and/or emptying fluid from the chamber. The gas compressor may be in the body. Compressed gas may be generated by compression of gas ahead of or adjacent the member when reciprocating. The drive means may comprise a linear motor, and the linear motor may comprise a free piston device.

In another embodiment, the percussion power tool may have hydraulic drive means for reciprocating the member in the body. The hydraulic fluid for the hydraulic drive means may also be supplied to the chamber for increasing the deadweight of the tool. There may be provided means for converting high pressure, low flow rate (e.g. 80 bar, less than 50 litres/min) hydraulic fluid for the hydraulic drive means into low pressure, high flow rate hydraulic fluid for the chamber. The converting means may comprise an ejector pump.

In general terms, the percussion power tool may have at least two chambers coupled to the body, each for receiving fluid to increase the deadweight of the tool. The at least two chambers may be symmetrically disposed around the body. Preferably, there are means for providing even distribution of fluid between the at least two chambers, thus giving a balanced weighting to the percussion power tool. For example, equal fluid flow split between two or more chambers may be achieved by equalling the head losses through different flow paths in a distribution manifold. Fine adjustment of the headlosses may be achieved by chamfering differently the various connections between the manifold and the chambers.

The percussion power tool may advantageously comprise means for indicating to an operator whether the deadweight of the tool has been increased, before the tool is lifted by the operator. The indicator may be visual (e.g. warning light), or it may be physical (e.g. a mechanism which until disengaged makes the handle rotate freely and therefore at least awkward to lift the tool).

In some applications, it may be required to operate the percussion power tool substantially horizontally instead of vertically. The chamber and the body may be coupled via a fulcrum in such a way that, in use, introducing fluid into the chamber urges the operative part of the tool into intimate contact with a work piece.

The fluid being used to increase the deadweight of the percussion power tool may have a specific gravity greater than one (i.e. density greater than 1000 kg/m$^3$). For example, the fluid may be of a type used in the oil exploration industry. Introducing fluid into the chamber may increase the deadweight of the tool by at least 10%, and possibly by at least 25%.

According to a second aspect of the present invention, there is provided a system for varying the deadweight of apparatus, comprising a chamber for mounting on the apparatus, a fluid reservoir supported independently of the apparatus, and means for cyclically filling the chamber with fluid from the reservoir in order to increase the deadweight of the apparatus and subsequently emptying the chamber by returning fluid to the reservoir in order to decrease the deadweight of the apparatus.

The deadweight of the apparatus is thus variable, and may be selected according to demands placed on the apparatus. The system is particularly suitable to portable apparatus, where weight is reduced to a minimum during transit to aid lifting and increased to a level necessary for the efficient operation of the device when it is in actual use. The apparatus may, for example, be a hand-held percussion power tool.

In the system, the movement of fluid between the chamber and the reservoir may be achieved by displacing fluid in part of the system with compressed gas. The chamber may comprise a membrane which flexes in sympathy with fluid filling or emptying from the chamber.

In accordance with yet another aspect of the present invention, there is provided a power tool driven by compressed gas, characterised in that the pressure of compressed gas supplied to the power tool is regulated by a valve disposed in the compressed gas supply line.

According to a fourth aspect of the present invention, there is provided a percussion power tool comprising a body, a member housed in the body for reciprocating percussive action, drive means for reciprocating the member in the body, wherein the drive means is arranged to drive a gas compressor. The power tool may further comprise a chamber coupled to the body, means for filling the chamber with fluid, and means for subsequently emptying the fluid from the chamber, the chamber being capable of being partially or completely filled with fluid to increase the deadweight of the tool when the member is reciprocating or percussing, and subsequently emptied when it is idle, and, the gas compressor providing the means for filling and emptying the chamber. The gas compressor may be in the body.

The compressed gas supply may be provided by the gas compression action of the reciprocating member. The means for filling the chamber with fluid may comprise a reservoir, supported independently of the body, for storing fluid for the chamber. The reservoir may be coupled to the body housing the reciprocating member enabling compressed gas from the body to pass to the reservoir. The means for coupling the body housing the reciprocating member and the reservoir may comprise valves to control the compressed gas flow, thus controlling fluid displacement for filling the chamber. The drive means may comprise a linear motor. The linear motor may comprise a free piston device.

In any of the above embodiments the fluid may act as a cooling agent for the percussion tool.

BRIEF DESCRIPTION OF THE DRAWINGS

The invention is diagrammatically illustrated, by way of example, in the accompanying drawings, in which.

MODES OF CARRYING OUT THE INVENTION

Figure 1:
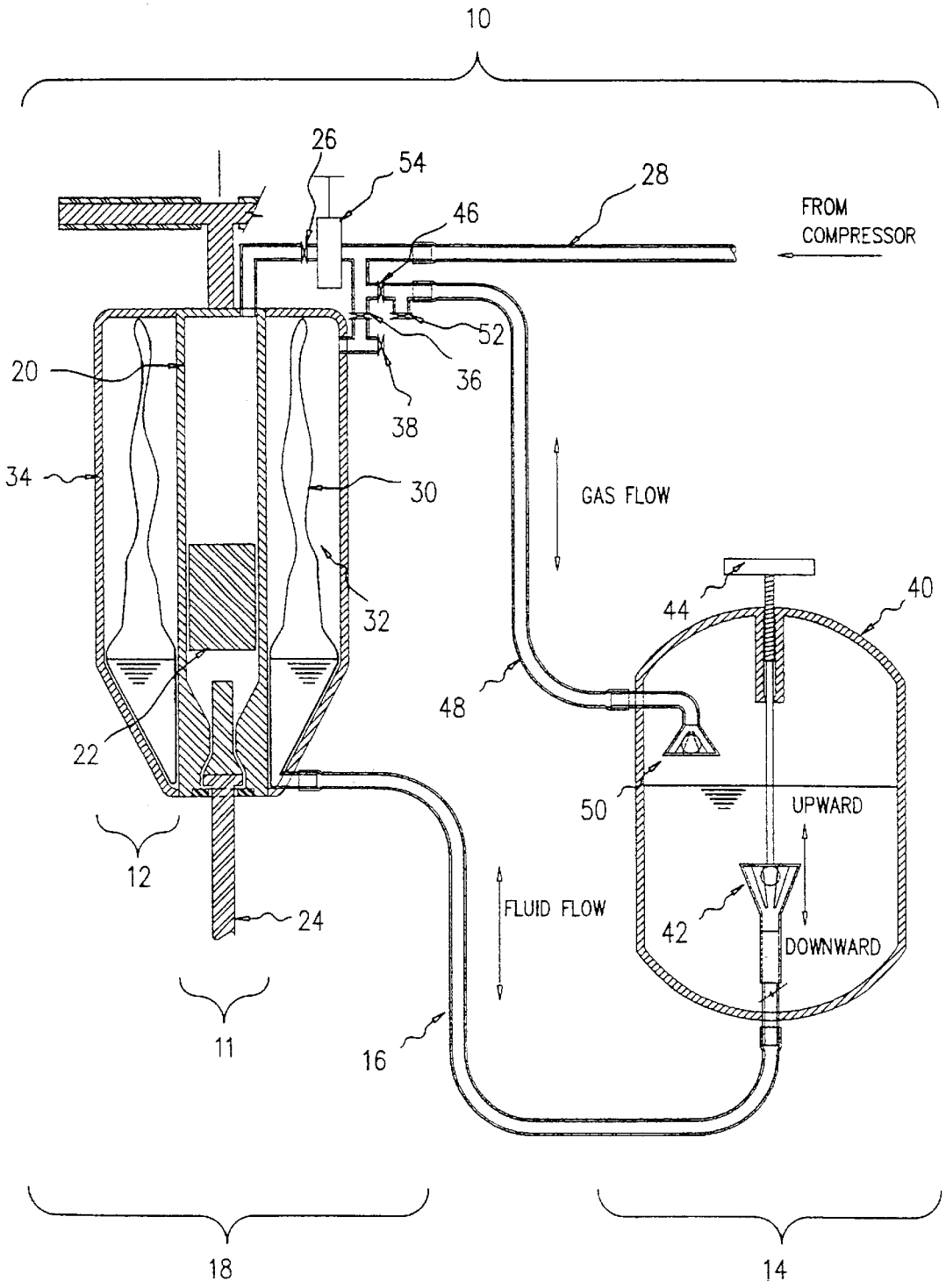
FIG. 1 shows a percussion power tool embodying the present invention.

FIG. 1 shows a percussion power tool assembly (10) comprising a hand-held percussion power tool (11), a chamber (12) mounted on the tool (11), and a fluid reservoir (14) supported independently of the tool (11). The chamber (12) communicates with the fluid reservoir (14) through flexible hose (16). The deadweight of the hand-held part (18) of the assembly (that is, the tool and chamber combined) is varied by transferring fluid, e.g. water, in the reservoir (14) to the chamber (12), and reduced by returning transferred fluid to the reservoir (14).

The percussion power tool (11) has a body (20) housing a reciprocating hammer (22) which impacts against tool bit (24) in a conventional manner. The hammer (22) is operated by compressed air admitted through valve (26) in feed line (28). The chamber (12) surrounds the body (20) and has a flexible lining (30) defining a bladder which inflates/deflates in sympathy with fluid filling, or emptying from, the chamber. Compressed gas, e.g. air, is admitted into the space (32) between the lining (30) and the chamber walls (34) through valve (36) in feed line (28). The lining (30) thus separates the compressed gas from the fluid. Assuming the lining (30) has negligible thickness, the capacity of the bladder varies from zero to the volume of the chamber (12) at the expense of the size of the space (32). A bleed valve (38) is provided to vent compressed gas from the space (32).

The reservoir (14) comprises a pressure vessel (40) having a sink (42) through which fluid passes into the hose (16). The height of the sink (42) within the pressure vessel (40) is varied by plunger (44). Compressed gas from a feed line (28) is admitted to the vessel (40) through a valve (46) and hose (48). As compressed air is introduced into the vessel (40), fluid is displaced and fluid level changes. The sink (42) and gas inlet (50) have protected openings to prevent gas entering hose (16) or fluid entering hose (48) respectively. A bleed valve (52) is provided to vent compressed gas from the vessel when necessary. A bleed valve (not shown) is also provided where hose (16) connects to the chamber (12) to allow priming of the hose (16).

When the percussion power tool is not in use (i.e. the hammer (22) is neither reciprocating nor percussing), the chamber (12) is empty of fluid (i.e. the bladder defined by lining (30) is fully deflated) and thus the part (18) is as light as possible. Before the reciprocating and percussive action is used, fluid should be transferred to the chamber (12) to increase the weight of the part (18). Bleed valve (38) is opened to vent the space (32) to atmosphere, and valve (46) is opened to introduce compressed air into the vessel (40). In this way, fluid in vessel (40) is displaced by the compressed gas pressure and is transferred through hose (16) to the bladder defined by flexible lining (30) in chamber (12). Once the chamber (12) is full with fluid, the reciprocating percussion action may be used safely.

Once the percussion power tool is no longer in active use (i.e. the hammer (22) is stationary) fluid in chamber (12) should be transferred back to the reservoir (14). To do this bleed valve (38) is closed and compressed gas admitted into the space (32) by opening valve (36). At the same time, valve (46) is closed and bleed valve (52) is opened to vent the vessel (40) to atmosphere.

A pressure regulating valve (54) is provided in feed line (28) to vary compressed air pressure delivered to the tool (11) and hence the power output to suit the job in hand.

In the assembly described thus far, fluid distribution between the chamber (12) and reservoir (40) is determined by applied pressures. This means that in order to transfer fluid from an equilibrium situation, the excess compressed air in one or other of the chamber or reservoir must be vented to introduce a pressure inbalance. To avoid unwanted delays, it would be possible to have:

(a) a valve on pipe (16) next to the fixed reservoir that opens only when the transfer of fluid is occurring. This is either achieved either by providing a flow meter so that at any time it is known whether the chamber is empty, partly filled or full; or by having proximity switches that detect the position of a piston/membrane in reservoir (40); or finally on a timer basis if for instance the valve is being kept open only a bit longer than the longest expected time of transfer.

(b) a mechanism activated when the piston/membrane reaches its lower point that overrides the system and releases the pressure to atmosphere. For instance if we are looking at reservoir (40), when fluid is being transferred to the tool, valve (52), is closed and valve (46) is open. As soon as the piston/membrane within the reservoir reaches the low point, a mechanism switches valves (46,52) to their opposite state.

FIGS. 2*a* and 2*b* show a valve arrangement (58) which combines compressed gas supply valves (36,46), and the bleed valves (38,52). The valve arrangement comprises a sliding gate (60) which has two operative positions. In a first position, FIG. 2*a,* gas supply valve (36) is open as is bleed valve (52) , whilst gas supply valve (46) and bleed valve (38) are closed. The first position enables fluid to be emptied from chamber (12). In a second position, FIG. 2*b,* gas supply valve (46) is open as is bleed valve (38), whilst gas supply valve (36) and bleed valve (52) are closed. The second position enables fluid to be displaced from the reservoir (14).

Figure 3:
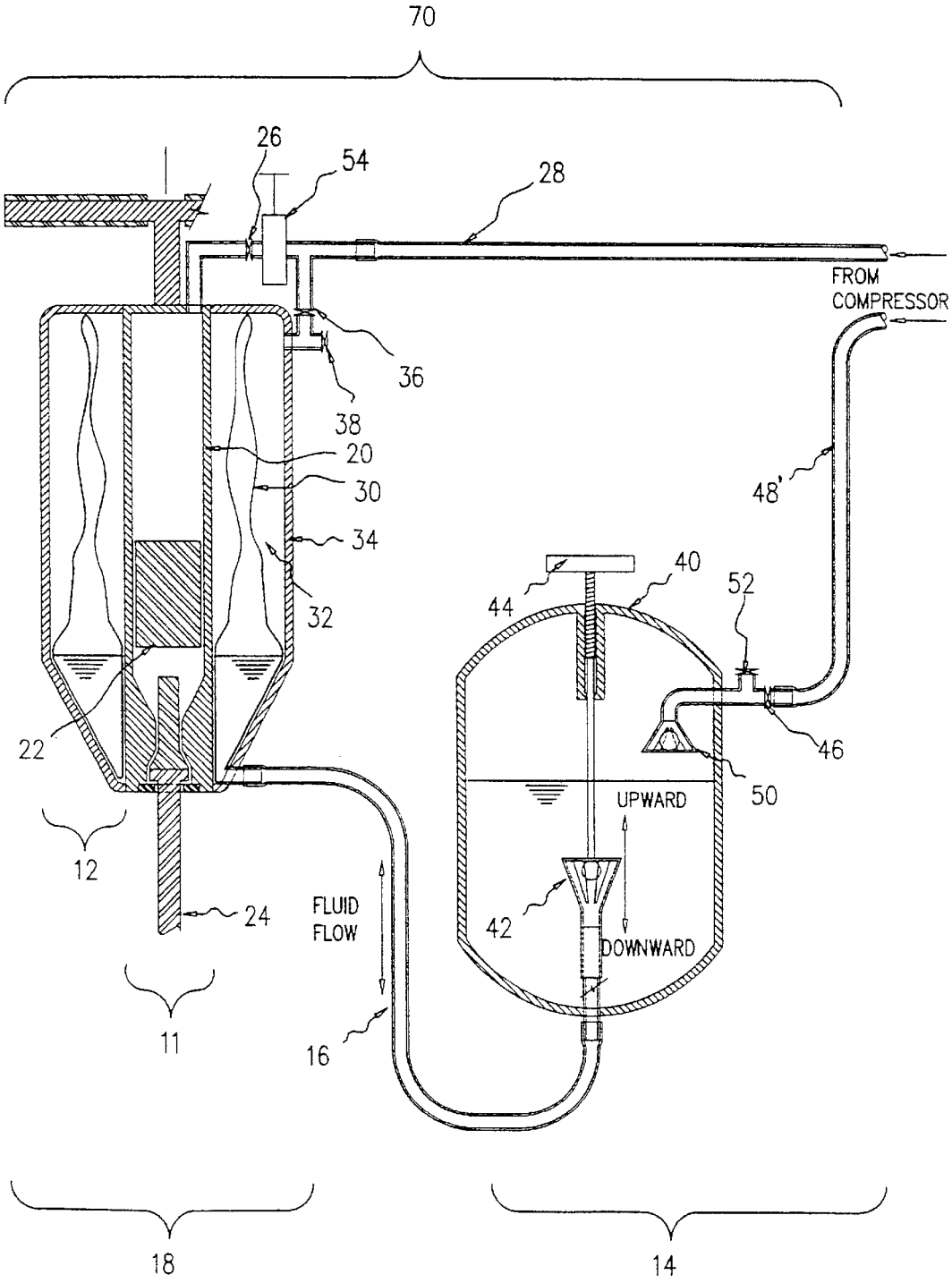
FIG. 3 shows a percussion power tool embodying the invention with an alternative arrangement of compressed gas feed.

FIG. 3 shows a percussion power tool assembly (70) with a different arrangement of compressed gas supply lines to the assembly (10) shown in FIG. 1. (Features common to FIGS. 1 and 3 share the same reference numerals). Instead of having a hose coupling the hand-held part (18) to the fluid reservoir (14), hose (48$^1$) provides a direct link between the source of compressed gas and the fluid reservoir (14). Thus, instead of having a hefty additional linkage between hand-held part (18) and reservoir (14) which may need to carry pressures up to 6–7 bars, all that is required is lightweight cabling to synchronise the opening and closing of valves (36,38,46,52).

Alternatively, rather than using light weight cabling to synchronise the opening and closing of valves (36,38,46,52), the pressure sensor provided on the compressor to control compressor output could be used. When an operator starts using the percussion power tool, there is a drop in pressure in the outlet chamber of the compressor. The drop in pressure is detected by the pressure sensor and the resulting signal from the sensor is used to increase the operating capacity of the compressor. The same signal could be used to control valves (46,52) and initiate the transfer of fluid to the chamber (12); valves (36,38) are controlled by the operator. When the operator stops using the percussion power tool, there is a pressure build up in the outlet chamber of the compressor. Again the pressure change is sensed by the pressure sensor and the new signal produced is used to decrease the operating capacity of the compressor. The new signal could be used to control valves (46,52) to return fluid to the reservoir (40).

Figure 4:
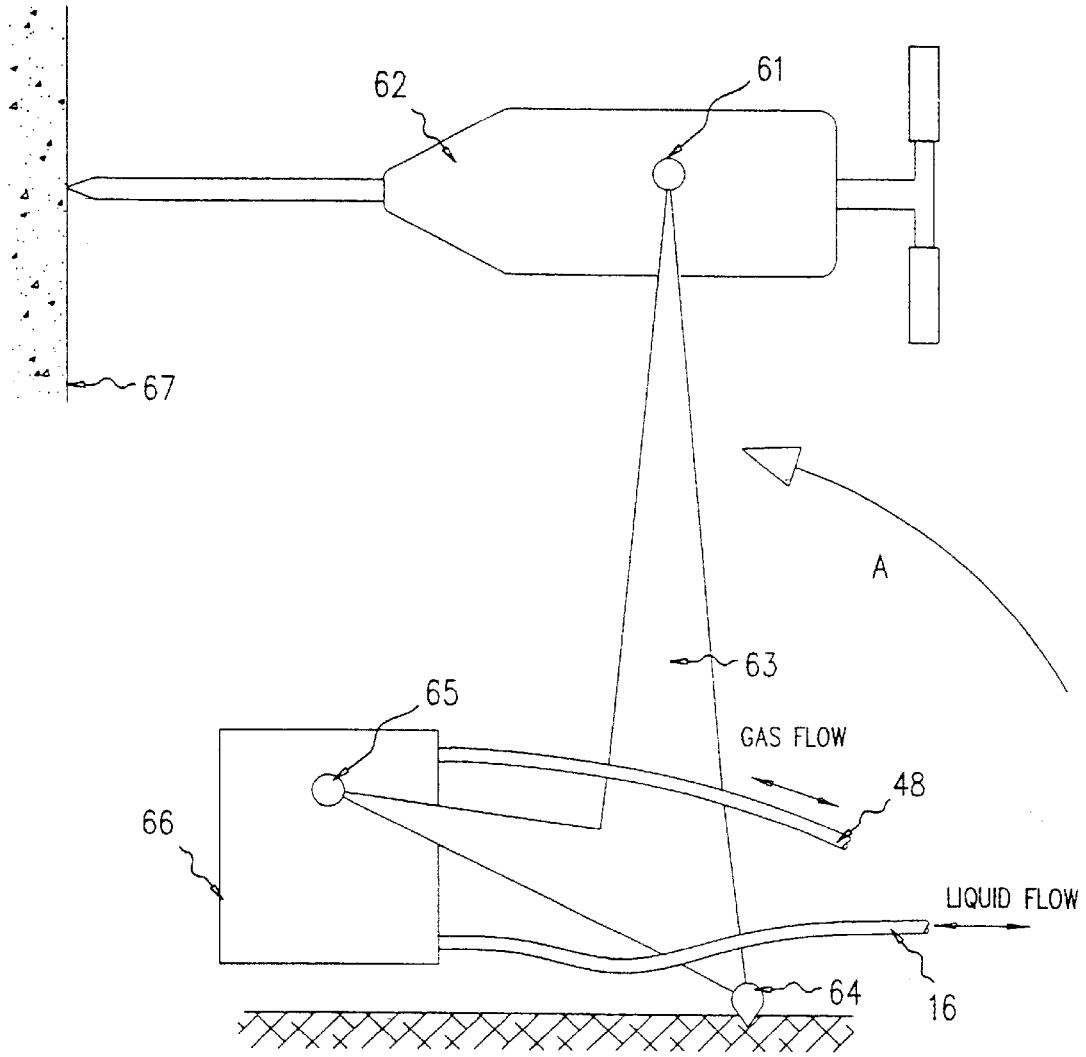
FIG. 4 shows an alternative percussion power tool embodying the present invention.

With reference to FIG. 4, vessel (66) has the same function as chamber (12), but is spaced from the tool (62) instead of surrounding it. The vessel (66) and tool (62) are pivotally supported, at couplings (65) and (61) respectively, by lever (63) which engages the ground through anti-slip support (64) which acts as a fulcrum. The lever (63) uses the vertical weight of the assembly (the main contribution to which is from the vessel (66) when filled with fluid) to generate a torque in the direction of arrow (A). The torque thus increases the force between the vertical face of workpiece (67) and the tool (62).

Figure 5:
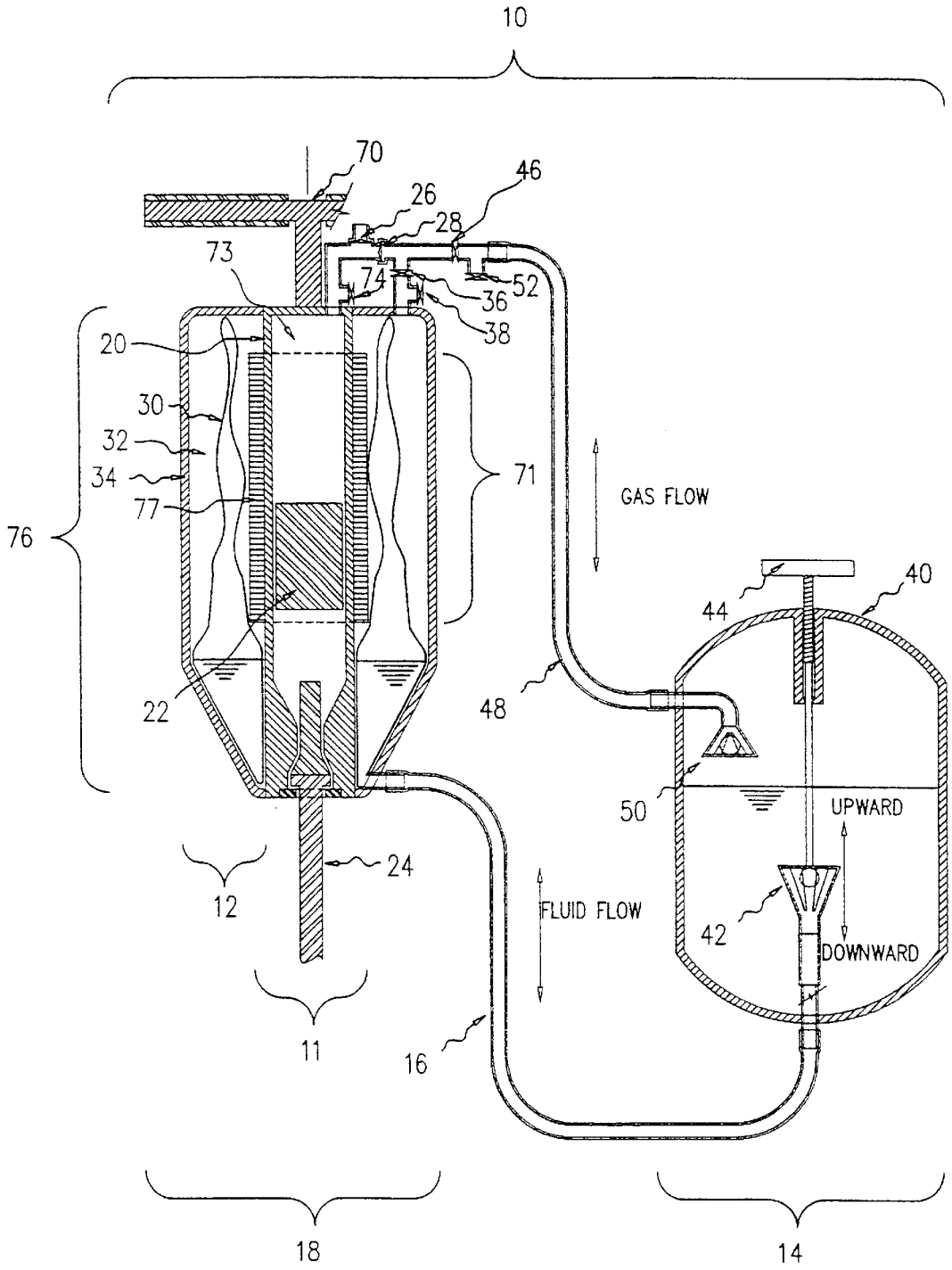
FIG. 5 shows a further embodiment of a percussion power tool embodying the present invention.

FIG. 5 shows a percussion power tool assembly (10) comprising a hand-held percussion power tool (11) in a housing (76) and a fluid reservoir (14) supported independently of the tool (11). A handle (75) extends from the top of the housing (76) and a tool bit (24) extends from the base of the housing (76).

The hand-held percussion power tool (11) comprises a body (20) centrally placed in the housing and defining a cavity (73), a member (22) in the form of a free piston slidably housed in the cavity (73) for reciprocating percussive action and a linear motor (71) forming a drive means for reciprocating the free piston (22) in the body (20). The linear motor (71) comprises the free piston (22) and a stator (77) which is a current carrying wire coiled around the body (20). When alternating current at an appropriate frequency is fed to the lower part of the stator (77) the member (22) is caused to oscillate in the bottom part of the cavity (73) striking the tool bit (24) at the bottom of the power stroke. The member (22) thus forms a hammer for imparting percussive energy to a tool bit (24).

The housing (76) also comprises a chamber (12) which surrounds the body (20) and has a flexible lining (30) defining a bladder which inflates/deflates in sympathy with fluid filling, or emptying from, the chamber (12). The reservoir (14) is connected to the chamber (12) via a flexible hose (16). The fluid reservoir (14) comprises a pressure vessel (40) having a sink (42) through which fluid passes into the hose (16) to provide the means for filling the chamber (12) with fluid and for subsequently emptying the fluid from the chamber (12). The height of the sink (42) within the pressure vessel (40) is varied by plunger (44). A bleed valve (not shown) is also provided where hose (16) connects to the chamber (12) to allow priming of the hose (16).

The chamber (12) is capable of being partially or completely filled with fluid from the reservoir to increase the deadweight of the tool (11) when the member is reciprocating or percussing, and subsequently emptied when it is idle. Assuming the lining (30) has negligible thickness, the capacity of the bladder varies from zero to the volume of the chamber (12) at the expense of the size of the space (32) between the lining (30) and the chamber walls (34).

Figure 2:
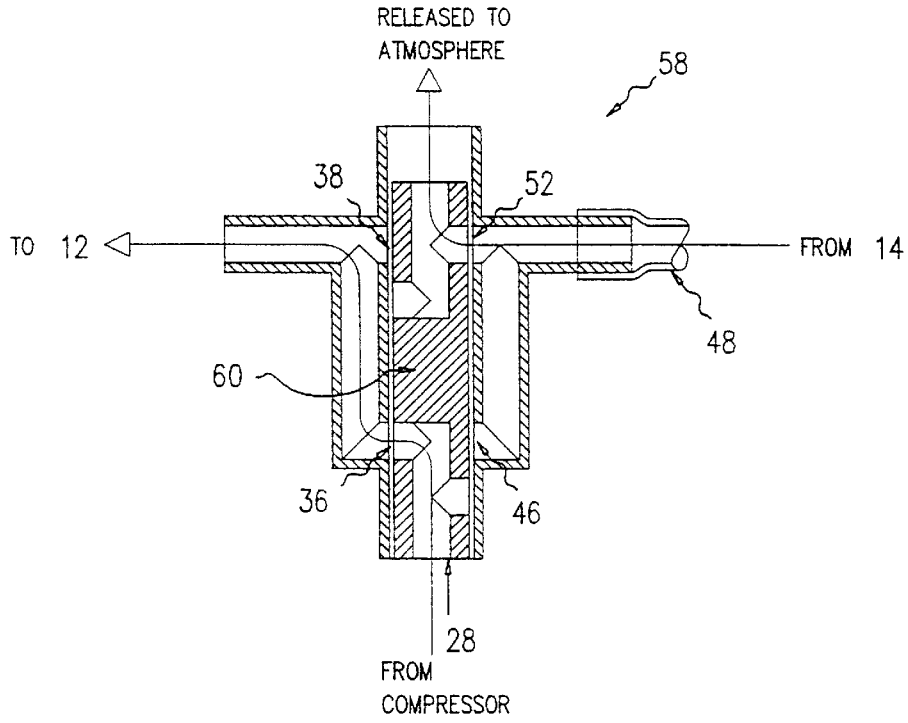
FIGS. 2(*a*) and (*b*) show valve detail of the percussion power tool of FIG. 1.
Figure 2:
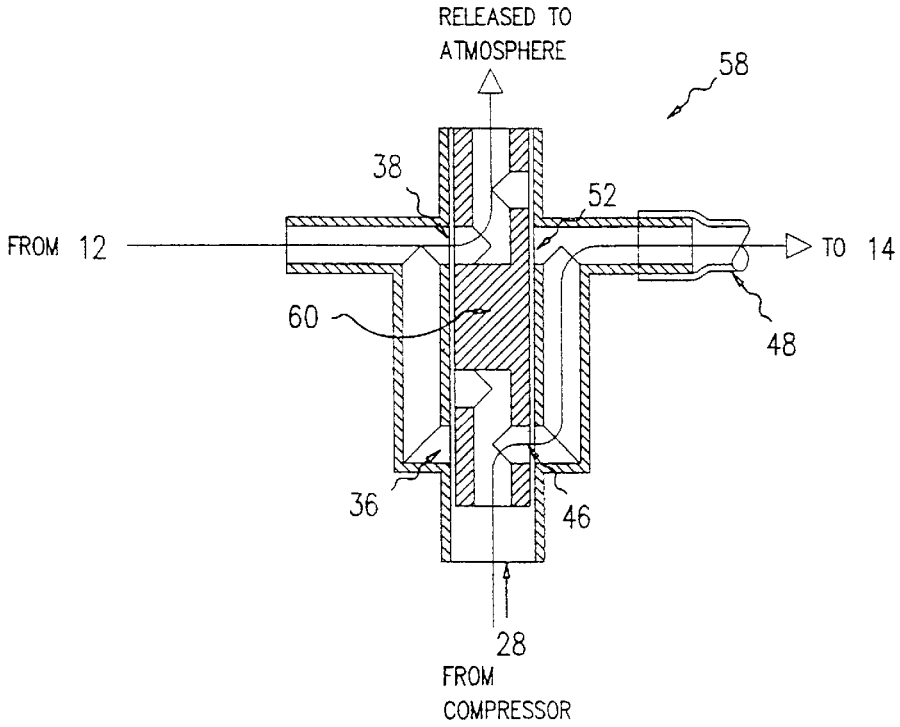

The linear motor (71) is also arranged to drive the gas compression action of the hammer (22), which action provides the means for filling and emptying the chamber (12) in a similar manner to the use of compressed gas from the external compressor of the embodiments illustrated in FIGS. 1 to 3. To drive the gas compression action of the hammer (22), alternate current at an appropriate frequency is fed to the upper part of the stator (77) causing the hammer (22) to oscillate in the upper part of the cavity (73). Inlet valve (26) is a non-return valve allowing gas to flow into the cavity (73) when the hammer (22) moves downward. As the hammer (22) moves upwards, gas in the cavity (73) is compressed. Thus the hammer (22) has a gas compression action in addition to its percussive or reciprocating action.

When the percussion power tool is not in use (i.e. the hammer (22) is neither reciprocating nor percussing), the chamber (12) is empty of fluid (i.e. the bladder defined by lining (30) is fully deflated) and thus the part (18) is as light as possible. Before the reciprocating and percussive action is used, fluid should be transferred to the chamber (12) to increase the weight of the part (18). Another advantage of transferring the fluid is the fluid will act as a cooling agent for the tool (11) while the hammer (22) is reciprocating.

To transfer the fluid, valve (36) is closed and bleed valve (38) is opened to vent the space (32) between the lining (30) and the chamber walls (34) to atmosphere. Bleed valves (52) and (74) are closed and valve (46) is opened to channel gas flow from the cavity (73) into the vessel (40).

Alternate current at an appropriate frequency is fed to the upper part of the stator (77) to drive the gas compression action of the hammer (22). As the hammer (22) moves upwards, gas in the body (20) above the hammer (22) is compressed and passed through outlet valve (28) and hose (48) to vessel (40). As compressed gas is introduced into the vessel (40), fluid is displaced and is transferred through hose (16) to the bladder defined by flexible lining (30) in chamber (12). The sink (42) and gas inlet (50) have protected openings to prevent compressed gas entering hose (16) or fluid entering hose (48) respectively.

Once the desired level of fluid has entered the chamber (12), valve (74) is opened to ensure that cavity (73) is at atmospheric pressure. Valve (28) is a non-return valve and since valves (36) and (52) remain closed, the compressed gas can not flow out of vessel (40). Thus the vessel (40) remains under pressure and consequently the amount of fluid in chamber (12) remains at the desired level. Once the percussion power tool is no longer in active use (i.e. the hammer (22) is stationary) fluid in chamber (12) should be transferred back to the reservoir (14). To do this bleed valves (38) and (74) are closed and valve (36) is opened to admit compressed gas into the space (32) between the lining (30) and the chamber walls (34). The lining (30) thus separates the compressed gas from the fluid. A bleed valve (38) is provided to vent compressed gas from the space (32). At the same time, valve (46) is closed and bleed valve (52) is opened to vent the vessel (40) to atmosphere.

Alternate current at an appropriate frequency is applied to the upper part of the stator (77) to drive the gas compression action of the hammer (22). The compressed gas passes through outlet valve (28) to space (32), thus displacing liquid from chamber (12) along hose (16) to vessel (40).

Figure 6:
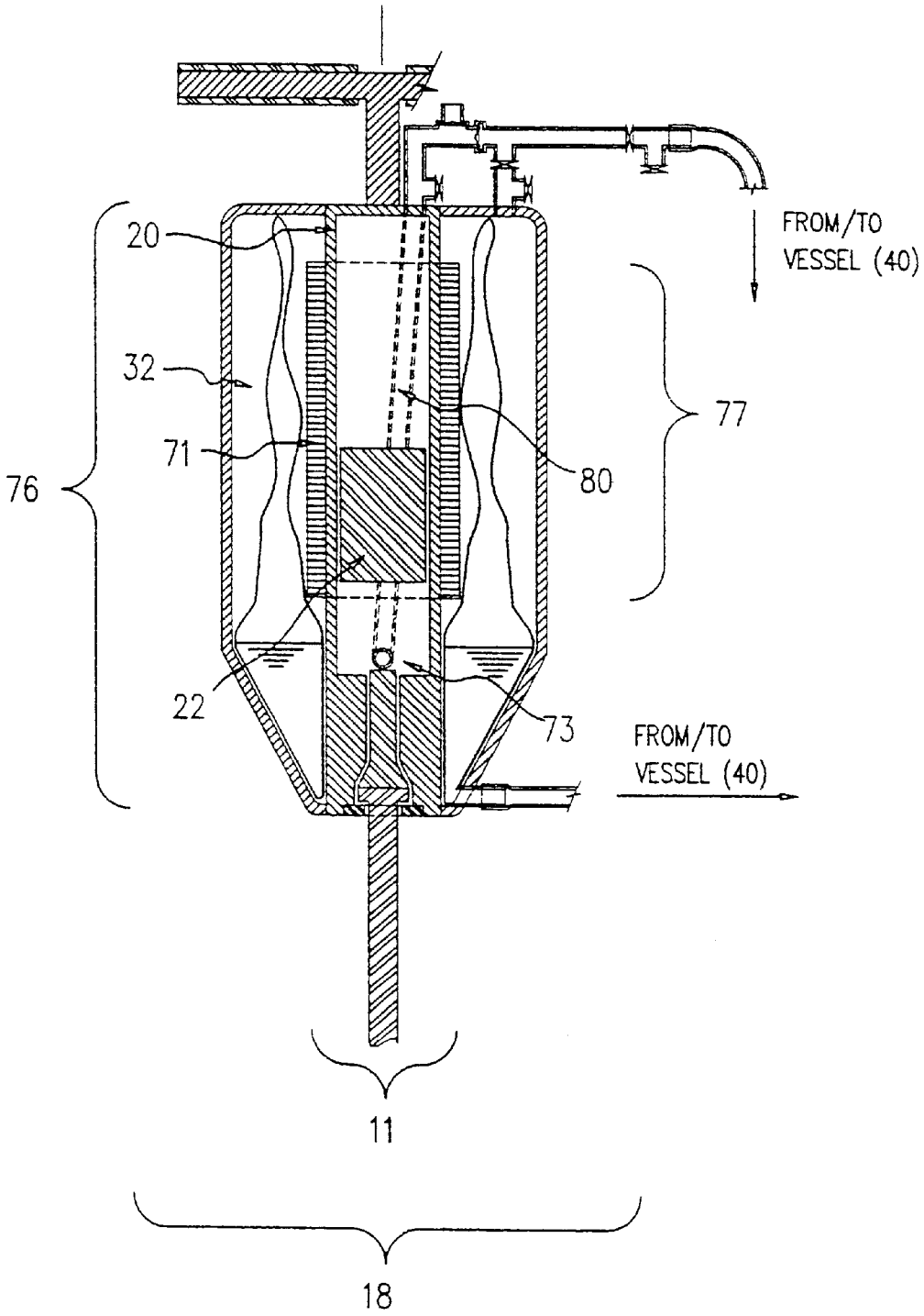
FIG. 6 shows alternative detail to the reciprocating action of the percussion power tool of FIG. 5.

The power tool assembly (10) depicted in FIG. 6, shows a different arrangement for gas compression compared to the power tool assembly (10) of FIG. 5 (common features have the same reference numeral). To drive the gas compression action of the hammer (22) in FIG. 6, alternate current at an appropriate frequency is fed to the lower part of the stator (77) causing the hammer (22) to oscillate in the lower part of the cavity (73). Inlet valve (26) is a non-return valve allowing gas to flow into the cavity (73) through pipe (80) when the hammer (22) moves upward. As the hammer (22) moves downwards, gas in the cavity (73) is compressed and passes along pipe (80) to be supplied to the vessel (40) or space (32) as in FIG. 5. It may be appreciated that although the gas compression actions described in FIGS. 5 and 6 are restricted to one direction of the hammer (22), it may be possible to have a dual-action compressor which compresses the gas on the upward and downward stroke of the hammer (22).

It should also be appreciated that although both FIGS. 5 and 6 depict a linear motor (71) to drive the gas compression action and the reciprocating action of the hammer (22), any suitable means, for example, a conventional hydraulic power arrangement, may be employed to drive both actions of the hammer (22).

Figure 7:
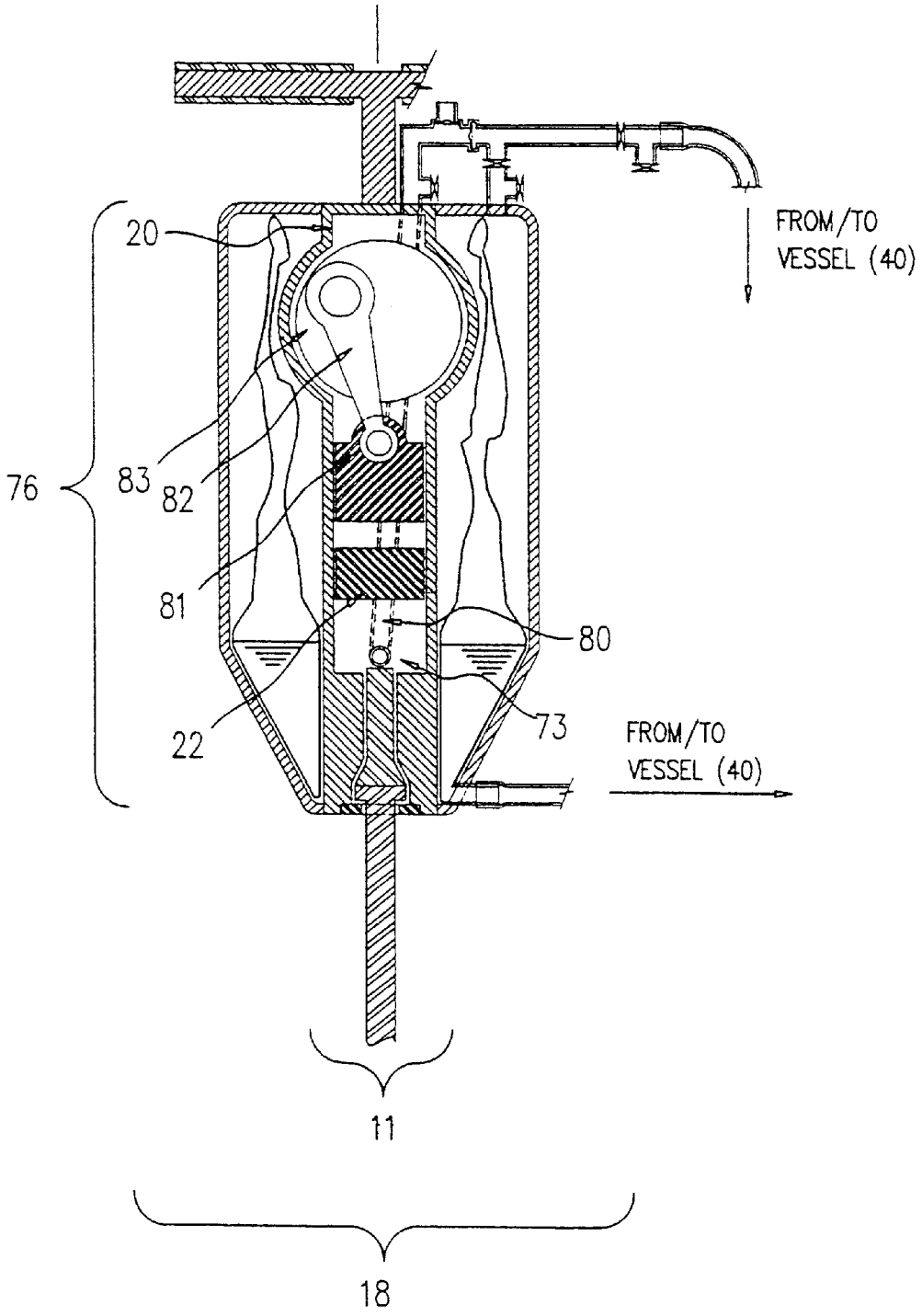
FIG. 7 shows yet another alternative to the reciprocating action of the percussion power tool of FIG. 5.

Alternative drive means include hydraulic, electric, pneumatic and internal combustion engine motors. One such arrangement is depicted in FIG. 7. An electric motor (not shown) or a petrol engine (not shown) power a crankshaft (83) in a conventional manner. Connecting rod (82) converts the rotational motion of the crankshaft (83) into linear motion of a piston (81) and the hammer (22). The hammer (22) is decoupled from the piston (81) and the hammer (22) has both a reciprocating action and a gas compression action. The gas compression action takes place in the lower part of the cavity (73) in a similar manner to the gas compression action described by the hammer (22) in FIG. 6.

Figure 8:
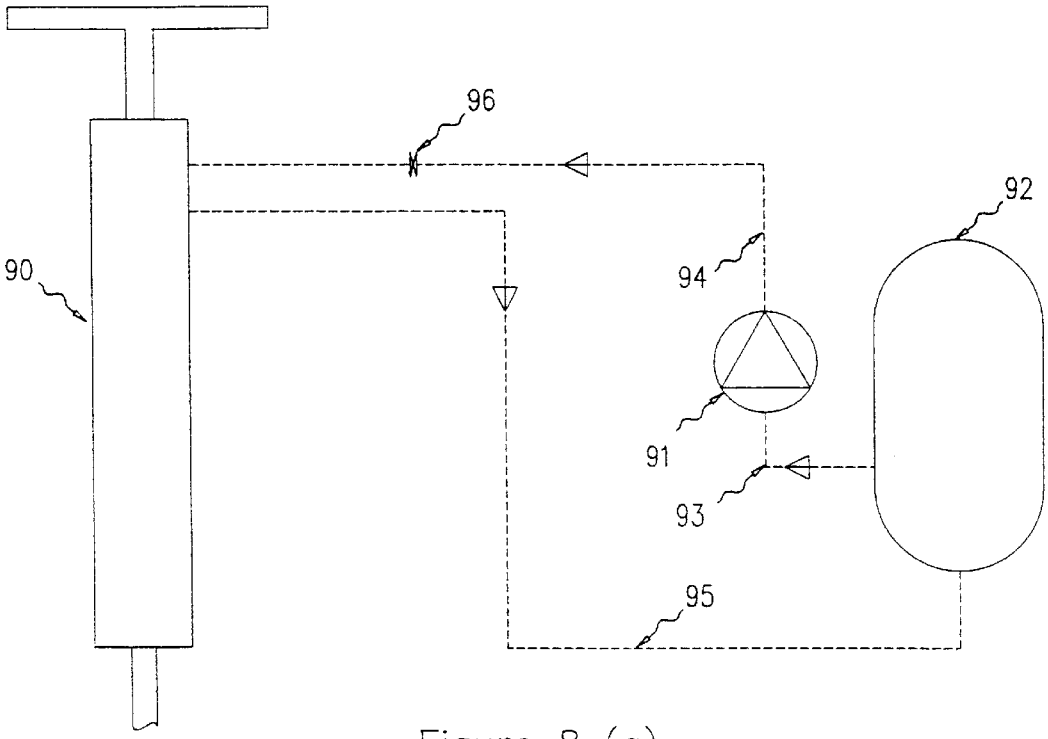
FIGS. 8 (*a*) and (*b*) illustrate how a conventional hydraulic percussion power tool might by adapted to embody the present invention.
Figure 8:
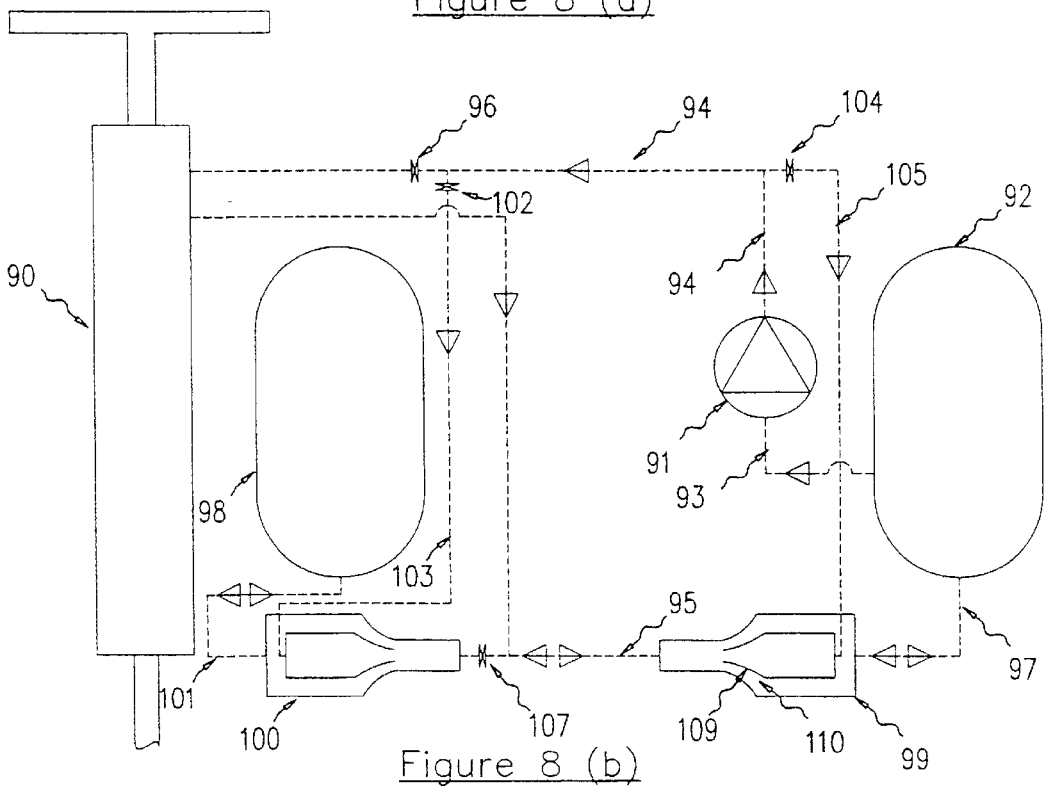

FIG. 8(*a*) shows a simplified schematic of a standard hydraulic breaker system where the hydraulic breaker (90) is powered by a pump (91) that withdraws fluid from an hydraulic reservoir (92) through suction pipe(93). Fluid is then delivered through delivery pipe (94) and returned to the hydraulic reservoir through return pipe (95). Valve (96) is operated by the user to control power supplied to the breaker. In commonly available systems, the maximum hydraulic flow is generally less than 501/min and pressure greater than 80 bar.

FIG. 8(*b*) shows a modified system with additional pipework and valving, where a hydraulic chamber (98) has been added to the hydraulic breaker (90) together with an ejector pump (100). A similar ejector pump (99) has been added to hydraulic reservoir (92). An ejector pump is a compact device that allows to convert a relative low flow at high pressure into high flow at low pressure. The low flow at high pressure is forced through nozzle (109), the resulting high velocity jet creates a suction force in duct (110) that draws flow from a reservoir. The two flows mix in a turbulent manner and the end result is that a high flow at low pressure is being delivered by the ejector pump.

In order to increase the dead weight of the tool, valves (96) and (102) need to be closed and valves (104) and 107) opened. Pump (91) delivers low flow at high pressure into ejector pump (99) through) pipe (105). Fluid is then withdrawn from reservoir (92) and delivered through pipe (97), ejector pump (100) which now acts as simple pipe, and finally through pipe (101) to chamber (98). In order to transfer the fluid back from chamber (98) to reservoir (92), valves (96) and (104) need to be closed and valves (102) and (107) opened. Pump (91) delivers low flow at high pressure into ejector pump (100) through pipe (103). Fluid is then withdrawn from chamber (98) and delivered through pipe (97), ejector pump (99) which now acts as a simple pipe, and finally through pipe (97) to reservoir (92).

When the hydraulic breaker is in percussion mode, valves (102), (104) and (107) are closed and the system works in a similar manner to that described with reference to FIG. 8 (*a*) with exception that return flow through pipe (95) now goes through ejector pump (99) which now acts as a simple pipe before reaching reservoir (92).

What is claimed is:

1. A percussion power tool comprising:

a body housing a member with a reciprocating percussive action;

a chamber coupled to the body and configured to store fluid additional to any fluid used to drive the reciprocating percussive action of the member;

a valve arrangement configured to introduce fluid into the storage chamber to increase deadweight of the tool by at least 10% when the member is operating with the reciprocating percussive action; and a valve arrangement configured to subsequently empty stored fluid from the storage chamber when the member is idle;

whereby tool deadweight is increased to a maximum when in active use and decreased to a minimum when not, by selectively controlling storage of fluid in the storage chamber.

2. A percussion power tool according to claim 1, in which the valve arrangement for introducing fluid into the storage chamber communicates with a reservoir, supported independently of the body, for storing fluid for the storage chamber.

3. A percussion power tool according to claim 2, in which the valve arrangement for emptying fluid from the storage chamber communicates with the reservoir.

4. A percussion power tool according to claim 1, in which the storage chamber comprises a membrane which flexes in sympathy with fluid being introduced into or emptied from the storage chamber.

5. A percussion power tool according to claim 4, in which the membrane constitutes a bladder.

6. A percussion power tool according to claim 1, in which the storage chamber houses a sliding partition element which moves in sympathy with fluid being introduced into or emptied from the storage chamber.

7. A percussion power tool according to claim 6, in which the sliding partition element is a piston.

8. A percussion power tool according to claim 1, in which at least one of the valve arrangement for introducing fluid into the storage chamber and the valve arrangement for emptying fluid from the chamber is operated by compressed gas.

9. A percussion power tool according to claim 8, in which compressed gas is used to displace fluid through at least one of the valve arrangement for introducing fluid into the storage chamber and the valve arrangement for emptying fluid from the storage chamber.

10. A percussion power tool according to claim 9, further comprising a valve assembly for coupling to a compressed gas supply, the valve assembly being configured to control fluid displacement for filling and emptying the storage chamber and the reciprocating percussive action of the member.

11. A percussion power tool according to claim 8, further comprising drive means for reciprocating the member in the body, the drive means being arranged to drive a gas compressor which provides compressed gas for the valve arrangement for introducing fluid into and the valve arrangement emptying fluid from the chamber.

12. A percussion power tool according to claim 11, in which the gas compressor is in the body.

13. A percussion power tool according to claim 12, in which compressed gas is generated by compression of gas ahead of or adjacent the member when reciprocating.

14. A percussion power tool according to claim 11, in which the drive means comprises a linear motor.

15. A percussion power tool according to claim 14, in which the linear motor comprises a free piston device.

16. A percussion power tool according to claim 1, further comprising a hydraulic drive for reciprocating the member in the body.

17. A percussion power tool according to claim 16, in which hydraulic fluid for the hydraulic drive is supplied to the chamber to increase the deadweight of the tool.

18. A percussion power tool according to claim 17, further comprising means for converting high pressure, low flow rate hydraulic fluid for the hydraulic drive into low pressure, high flow rate hydraulic fluid for the chamber.

19. A percussion power tool according to claim 18, in which the converting means comprises an ejector pump.

20. A percussion power tool according to claim 1, in which at least two chambers are coupled to the body, each for receiving fluid to increase the deadweight of the tool.

21. A percussion power tool according to claim 20, in which the at least two chambers are symmetrically disposed around the body.

22. A percussion power tool according to claim 20, further comprising means for providing even distribution of fluid between the at least two chambers when the deadweight of the tool is increased.

23. A percussion power tool according to claim 1, further comprising an indicator for indicating to an operator.

whether the deadweight of the tool has been increased, before the tool is lifted by the operator.

24. A percussion power tool according to claim 1, in which the chamber and the body are coupled via a fulcrum in such a way that, in use, introducing fluid into the chamber urges the operative part of the percussion power tool into intimate contact with a work piece.

25. A percussion power tool according to claim 24, in which the operative part of the percussion power tool is substantially horizontal when in working contact with the work piece.

26. A percussion power tool according to claim 1, in which fluid introduced into the chamber additionally absorbs heat generated during reciprocation of the member.

27. A percussion power tool according to claim 1, wherein the valve arrangement is configured to introduce fluid into the storage chamber to increase the deadweight of the tool by at least 25% when the member is operating with the reciprocating percussive action.

* * * * *